United States Patent [19]

Martin

[11] Patent Number: 5,005,704

[45] Date of Patent: Apr. 9, 1991

[54] DISPOSABLE TACO HOLDER

[76] Inventor: Russell E. Martin, 5420 Beckner Str., Norfolk, Va. 23509

[21] Appl. No.: 870,418

[22] Filed: Jun. 4, 1986

[51] Int. Cl.[5] ..... B65D 5/42

[52] U.S. Cl. ..... 206/564; 229/DIG. 13; 248/174; 426/132

[58] Field of Search ..... 426/110, 115, 128, 132; 229/52 AM, 52 AW, DIG. 7, DIG. 13; 248/152, 174, 459; 211/72, 73; 206/562–564, 813; D7/76, 72, 388, 411; D9/455, 346, 431; D1/102–105

[56] References Cited

U.S. PATENT DOCUMENTS

| | | | |
|---|---|---|---|
| D. 226,805 | 5/1973 | Nevai | D9/346 |
| 873,421 | 12/1907 | Fleming | 248/174 |
| 1,543,102 | 6/1925 | Fleischer | 248/174 |
| 1,687,138 | 10/1928 | Myers | 211/73 |
| 2,125,784 | 8/1938 | Higgins | 248/174 |
| 2,299,829 | 10/1942 | Feddersen et al. | 248/174 |
| 2,367,675 | 1/1945 | Greenleaf | 229/DIG. 13 |
| 2,564,244 | 8/1951 | Bibler | 206/45.31 |
| 2,876,114 | 3/1959 | Robertson et al. | 248/174 |
| 3,080,997 | 3/1963 | Brown | 206/813 |
| 3,744,704 | 7/1973 | Struble | D9/346 |
| 4,573,570 | 3/1986 | Cortopassi | 248/174 |

FOREIGN PATENT DOCUMENTS

| | | | |
|---|---|---|---|
| 821667 | 12/1937 | France | 211/73 |

*Primary Examiner*—Gary E. Elkins

*Attorney, Agent, or Firm*—Jay M. Cantor

[57] ABSTRACT

The disclosure relates to a taco holder wherein a blank is provided with a central region and four legs extending outwardly from the central region, a pair of adjacent legs on each side of the central region. Each leg is in the shape of a right triangle with each leg being secured to the central region at a crease. Each leg includes a notch at a portion thereof remote from the central region, a pair of legs on opposite sides of the central region being opposed to each other whereby the notches therein can mate and form a V-shaped trough. Two such V-shaped troughs are thereby formed to support a taco therein. An adhesive material can be disposed on a surface of the central region to secure the taco holder to a table or the like to free the hands of the taco maker and also to prevent sliding of the taco during preparation or eating thereof.

9 Claims, 1 Drawing Sheet

DISPOSABLE TACO HOLDER

BACKGROUND OF THE INVENTION

1. Field of the Invention

This invention relates to a disposable taco holder and, more specifically, to a precreased or scored and slotted paperboard blank which can be stamped out from larger paperboard sheets, stored as flat sheets, one atop the other, and assembled as required for use.

2. Brief Description of the Prior Art

Due to the high cost of labor required in preparation for reuse of eating utensils and food holders as well as the high cost of the reusable utensils and food holders due to breakage, loss and the like, such reusable instrumentalities are increasingly being replaced by disposable devices such as those made of paper and plastic, especially in the fast food area where labor costs are critical. In this regard, paper plates as well as plastic eating utensils have been widely used for many decades. However, in the case of the preparation and serving of certain specialize d edibles, the standard well known plates fail to provide the support desired. For example, in the case of a taco, it is necessary that the taco shell be supported in an upright position while the shell is filled with the appropriate ingredients and that the filled taco shell then be retained in the supported position until served to a customer to retain the filling within the shell. It is also desirable that the support be usable by the customer so that the taco can be supported at times during the eating operation. Also, as stated above, it is highly desirable that the support be inexpensive, easy to store and assemble and readily disposable. Prior art attempts have been made to provide food holders, however they have generally been somewhat lacking in one or more of the above noted properties. It is therefore apparent that there has been a long felt need in the art for a taco holder which will possess the above noted desirable properties.

SUMMARY OF THE INVENTION

In accordance with the present invention, there is provided a taco holder which provides all of the above noted properties.

Briefly, in accordance with the present invention, there is provided a taco holder for maintaining a taco food product in an upright position during preparation and serving wherein the holder is formed from a blank of semi-rigid material, such as cardboard, closed cell foam plastic (styrofoam) or the like, stamped or cut out from a larger sheet of the same material and having a rectangular center portion. Four legs extend outwardly from said center portion, a first pair of said legs being secured to a first side of the rectangle perimeter and a second pair of legs being secured to a second side of the rectangle perimeter opposite said first side. Each leg is in the shape of a right triangle with a portion of the triangle remote from the rectangle cut off to provide a trapezoidal shape thereto. Legs on opposite sloes of the rectangle are mirror images of each other both as to shape and location. Each of the legs on one side of the rectangle has a notch therein opening in a direction parallel to the base of the triangle of which it is a part, each of the legs on the other side of the rectangle having a notch therein opening in a direction parallel to the base of the triangle of which it is a part but facing in a direction opposite to the leg of which it is a mirror image. The line of attachment between each leg and said rectangle is scored or has a crease to allow bending of each leg relative to the rectangle. One surface of each rectangle includes a tacky non-settable adhesive material thereon which permits stacking of the blanks and securing thereof to adjacent blanks. This adhesive also permits the later assembled taco holder to be secured to a tray or the like during taco preparation or consumption via the tacky material. As an alternative, an adhesive can be provided under a peel off strip whereby the adhesive action takes place only after removal of the strip. In this embodiment, while the stacking of blanks can take place, there is no adhesive action therebetween in the stacked condition. Both of the above discussed types of adhesive are well known in other arts.

In operation, the taco chef will peel one of the above described blanks from a stack of such blanks and bend the legs toward each other at the score or Crease lines and over the side o( the rectangle which has no tacky material thereon. Opposing notches are then interlocked to provide the constructed taco holder. The taco holder is then placed upon a support, such as a tray, table or the like whereupon the tacky material on the bottom of the holder will stick to the support. The taco shell is then placed in the taco holder between the pairs of interlocked legs and filled whereupon the filled taco is dispensed in standard manner while in the holder. There is no need to hold the taco shell during filling, thereby freeing both hands of the taco maker for other duties.

It can be seen that there is provided a simple, inexpensive, easily assembled and easily stored taco holder which is disposable and meets the criteria desired for such devices.

DESCRIPTION OF THE PREFERRED EMBODIMENT

Figure 2:
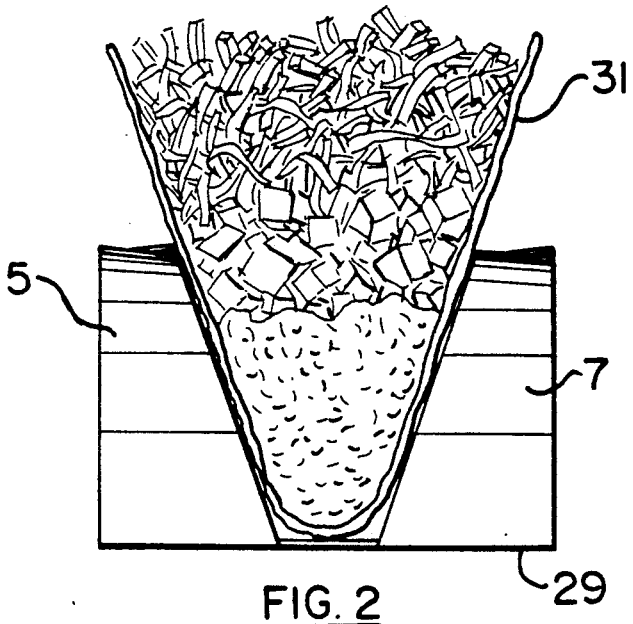
FIG. 2 is on end view of the assembled blank of FIG. 1 with a taco positioned therein.
Figure 1:
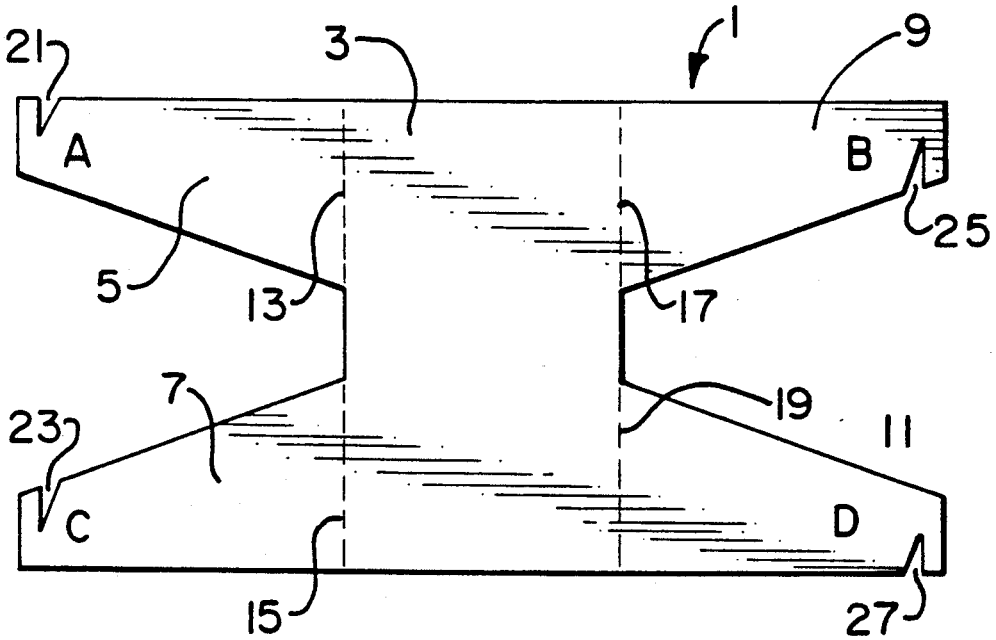
FIG. 1 is a top view of a taco holder blank in accordance with the present invention.

Referring now to FIG. 1, there is shown a blank in accordance with the present invention which has been cut and creased as will be explained hereinbelow. A plurality of such blanks can be stacked, one atop the other, and held together by a tacky adhesive disposed thereon. The pattern 1 includes a rectangular center section 3 having the above mentioned tacky material adhered to its under side as shown in FIG. 2 at 29. Legs 5, 7, 9 and 11 are secured to the rectangular member 3 at crease lines 13, 15, 17 and 19 which are at the perimeter of the rectangular portion 3. The pairs of opposing legs 5, 9 and 7, 11 are essentially mirror images of each other except that the notches 21, 25 and 23, 27 thereof extend in opposite directions. The legs as shown are of right triangular shape with the angle away from the rectangle being cut off just beyond the notches and parallel to the triangle base.

In operation, the blank of FIG. 1 is peeled from a stack of such blanks with the tacky material 29 being on the bottom surface of section 3. The legs 5 and 9 are bent toward each other along the crease lines 13 and 17 in a direction so that these legs meet on the side of section 3 opposite the tacky side of said section. The notches 21 and 25 are then affixed within each other. The same procedure is then followed with respect to legs 7 and 11. The result is an assembled taco holder as shown in FIG. 2 which is now placed upon a support with the tacky material 29 facing toward the suppOrt so that the taco holder will now adhere to the support. A taco shell 31 is then disposed in the taco holder to extend between legs 5, 7 and legs 9, 11 as shown in FIG. 2 whereby the taco shell is supported in an upright position for filling and the like.

It can be seen that there has been provided a taco holder which is disposable, easy to assemble and inexpensive and which meets all of the demands of such devices as noted hereinable.

Though the invention has been described with respect to a specific preferred embodiment thereof, many variations and modification will immediately become apparent to those skilled in the art it is therefore the intention that the appended claims by interpreted as broadly as possible in view of the prior art to include all such variations and modifications.

I claim:

1. An assemblable holder for comestible products, which comprises:

(a) a sheet having substantially negligible thickness dimension, formed of a semi-rigid material and having:

(b) a central region, said central region having at least one pair of spaced parallel sides;

(c) first and second spaced apart legs secured to and spaced along one of said spaced parallel sides, each of said first and second legs having a first side most closely adjacent a first side of the other of said first and second legs and extending outwardly from said central region, said first sides forming a substantially V-shaped trough, each of said first and second legs having a notch at one end portion thereof remote from said central region extending in a direction parallel to said spaced parallel sides, and a crease in the material at the juncture of said first and second legs and said central region;

(d) third and fourth spaced apart legs secured to and spaced along the other of said spaced parallel sides, each of said third and fourth legs having a first side most closely adjacent a first side of the other of said third and fourth legs and extending outwardly from said central region, said first sides forming a substantially V-shaped trough, each of said third and fourth legs having a notch at one end portion thereof remote from said central region extending in a direction parallel to said spaced parallel sides, the notch in said first leg extending in a direction opposite to said notch in said third leg and said notch in said second leg extending in a direction opposite to said notch in said fourth leg, and a crease in the material at the juncture of said third and fourth legs and said central region, said legs being folded toward each other along said crease with the notch of said first leg engaging the notch of said third leg and the notch of said second leg engaging the notch of said fourth leg to form said taco holder.

2. A holder as set forth in claim 1 wherein each said leg is of substantially triangular shape, the angles of said triangles disposed along said creases being no greater than ninety degrees.

3. A holder as set forth in claim 2 wherein each of said triangles is a right triangle, the right angles of said triangles secured to the same side of said central region being remote from each other.

4. A holder as set forth in claim 2 wherein each of said triangles is a right triangle, the right angles of said triangles secured to the same side of said central region being remote from each other.

5. A holder as set forth in claim 1 further including a non-setting adhesive secured to one surface of said central region.

6. A holder as set forth in claim 2 further including a non-setting adhesive secured to one surface of said central region.

7. A holder as set forth in claim 4 further including a non-setting adhesive secured to one surface of said central region.

8. A one piece support for holding a taco in upright position comprising:

(a) as elongated flat strip of semi-rigid material having opposite parallel sides, (b) two longitudinally spaced pairs of arms, the arms of each pair being spaced from each other by substantially the thickness of a taco, each pair of arms projecting substantially upwardly from opposing ones of said opposite parallel sides of the flat strip to delineate a bottom portion, said arms terminating freely at their distal ends, and extending over the bottom portion with the free ends of each arm in meeting engagement with one opposing arm of the other pair, (c) cooperating means on the arms closely adjacent their free ends for securing together the respective free ends of the opposed arms of the respective pairs of arms whereby the taco may be supported on the bottom portion between the pairs of the longitudinally spaced arms, and (d) the material of the strip is creased at the juncture of the arms and bottom portion to permit opposed pairs of said arms to be swung toward each other to interlock at their respective free ends.

9. A one-piece support according to claim 8 wherein said cooperating means comprises a transverse slit adjacent the free end of each of the arms.

* * * * *